US007378941B2

(12) United States Patent
Ashizawa

(10) Patent No.: US 7,378,941 B2
(45) Date of Patent: May 27, 2008

(54) METHOD FOR SETTING PRODUCT NUMBER IN ROM TYPE RFID CHIP AND METHOD, APPARATUS AND SYSTEM FOR MANAGING PRODUCT IMPLEMENTATION

(75) Inventor: Minoru Ashizawa, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 612 days.

(21) Appl. No.: 10/931,676

(22) Filed: Aug. 31, 2004

(65) Prior Publication Data

US 2005/0140502 A1 Jun. 30, 2005

(30) Foreign Application Priority Data

Dec. 26, 2003 (JP) ..... 2003-435585

(51) Int. Cl.
*G07G 1/14* (2006.01)

(52) U.S. Cl. ..... 340/10.52; 340/10.1; 340/572.4

(58) Field of Classification Search ..... 340/10.51, 340/10.52, 10.1, 572.4, 10.5
See application file for complete search history.

(56) References Cited

U.S. PATENT DOCUMENTS 6,172,596 B1 * 1/2001 Cesar et al. ..... 340/10.41
6,196,466 B1 * 3/2001 Schuessler ..... 235/494
7,190,257 B2 * 3/2007 Maltseff et al. ..... 340/10.51
2002/0004767 A1 1/2002 Okamoto et al.
2003/0169149 A1 9/2003 Okhi et al.
2003/0234718 A1 * 12/2003 Fujisawa et al. ..... 340/5.1

* cited by examiner

*Primary Examiner*—Edwin C. Holloway, III
(74) *Attorney, Agent, or Firm*—Townsend and Townsend and Crew LLP

(57) ABSTRACT

ROM type RFID chips are produced while data (production numbers) assigned by a user are set in the ROM type RFID chips respectively. A header and an EDC are added and embedded to each data to thereby form an ID format. In the ID format, an application data field may be divided into a user number field and a serial number field in order to verify uniqueness of the data assigned by the user. Or the application data field may be entirely used for the set data assigned by the user in order to verify uniqueness of the numbers assigned by the user. Accordingly, production numbers can be set in chips on the basis of the data assigned by the user. As a result, verification for checking whether each product is genuine can be dispensed with, so that the cost of communication can be reduced.

10 Claims, 6 Drawing Sheets

CHARACTER CONVERSION TABLE (6 bits)

| PRODUCTION NUMBER CHARACTERISTIC | ENCODED NUMBER |
|---|---|
| 0 ~ 9 | 0 ~ 9 |
| A ~ Z | 10 ~ 35 |
| + - ( ) # % | 36 ~ 41 |

ID FORMAT

PRODUCT NUMBER SETTING APPARATUS 3

PRODUCT IMPLEMENTATION MANAGING APPARATUS 2

METHOD FOR SETTING PRODUCT NUMBER IN ROM TYPE RFID CHIP AND METHOD, APPARATUS AND SYSTEM FOR MANAGING PRODUCT IMPLEMENTATION

INCORPORATION BY REFERENCE

The present application claims priority from Japanese application JP2003-435585 filed Dec. 26, 2003, the content of which is hereby incorporated by reference into this application.

BACKGROUND OF THE INVENTION

1. Field of the Invention

The present invention relates to a method for setting product numbers in ROM (Read-Only-Memory) type RFID chips by using a computer, and a method, an apparatus and a system for managing product implementation.

2. Description of the Related Art

Wireless tags have recently come into wide use for various purposes of entrance and exit management, sales management, inventory management, production management, ID verification, etc. The wireless tags have been not standardized yet in terms of names and definitions thereof. That is, various names such as "RFID tag", "RFID chip", "contactless ID tag", "wireless ID tag", "contactless tag", etc. have been given to the wireless tags in accordance with chip makers. In this description, a module including a wireless communication IC and an antenna is referred to as "wireless tag". Incidentally, RFID is an abbreviation for Radio Frequency IDentification.

Incidentally, there is provided a wireless tag structure adapted to a judgment as to whether an article is genuine. A wireless tag having a read-only memory (ROM) is used for checking accurately whether the article is genuine. A wireless tag reader has been proposed (see JP-A-2003-263622). According to JP-A-2003-263622, a service identification code having a value common to a plurality of wireless tags for indicating a common purpose and service data having different values corresponding to wireless tags are provided as tag data. Moreover, the data structure of a wireless tag having an ROM is divided into a service identification code common to articles and continuous data for managing the articles. When the service identification code assigned to an article is checked, a judgment can be made as to whether the article is genuine.

On the other hand, an ID management method and a management system have been proposed (see JP-A-2002-24767). According to JP-A-2002-24767, there is provided a mechanism in which both issuing and circulation of IDs having message authentication codes (MAC) and allowed to be assigned to articles individually are managed so that management of articles can be performed efficiently and reliably by use of the IDs. Incidentally, in the technique according to JP-A-2002-24767, attribute information (which is attribute information for classifying IDs and which is information for indicating the fields of use of IDs or names of client companies) and a message authentication code are written in a wireless ID tag.

IC chips used in wireless tags are classified into IC chips of the type using non-rewritable ROMs as memory portions (hereinafter referred to as "ROM type RFID chips") and IC chips of the type using rewritable RAMs (Random Access Memories) as memory portions (hereinafter referred to as "RAM type RFID chips").

As described in JP-A-2003-263622 and JP-A-2002-24767, data are written in the ROM type RFID chips at the time of production in the factory. For this reason, users cannot change the data when the ROM type RFID chips are supplied to the users. On the other hand, the RAM type RFID chips are configured so that users can write data. For this reason, use of the RAM type RFID chips for anti-counterfeit purposes is risky though the RAM type RFID chips can provide a high degree of freedom.

Identification information for user products is set in the ROM type RFID chips. Because each semiconductor maker generally gives serial numbers to the ROM type RFID chips uniquely, any other person cannot set the numbers. On the other hand, the RAM type RFID chips may make unstable operations in addition to the aforementioned disadvantage. Accordingly, there is some case where the ROM type RFID chips may be absolutely advantageous and essential. It is however necessary to verify sequential data attached to the products by each user (product maker) to check whether the products are genuine because sequential data (serial numbers) are stored in the ROM type RFID chips by the semiconductor maker. Accordingly, it is necessary to inquire of a server about this verification at each time it happens. The ROM type RFID chips have a disadvantage that the cost of communication is high.

SUMMARY OF THE INVENTION

The present invention has been developed in consideration of such circumstances. An object of the present invention is to provide a product number setting method which is applied to ROM type RFID chips so that production numbers (product numbers) can be set in the ROM type RFID chips on the basis of data assigned by a user to thereby make the aforementioned verification needless to attain reduction in the cost of communication. Another object of the invention is to provide a method, an apparatus and a system for managing product implementation in the ROM type RFID chips.

To solve the aforementioned problem, there is provided a method of setting the numbers of products in RFID chips respectively by using a computer, comprising the steps of:

- sending an ID format inclusive of character restrictions to a user terminal;
- inputting a product number list including product numbers assigned in accordance with a user's instruction into an application data field of a memory in said computer;
- encoding said production numbers into chip IDs by using a character conversion table and verifying whether each encoded chip ID is not duplicate to any ID having been already assigned by the user in order to store the encoded chip IDs as unique chip IDs; and
- setting said unique chip IDs read from said computer in read-only memories of said RFID chips respectively and providing antennas in said RFID chips respectively. In accordance with the invention, data (production numbers) assigned by a user are set in ROM type RFID chips when the ROM type RFID chips are produced. A header and an EDC (Error Detecting Code) may be added to or embedded in each of the data. In this format, an application data field may be divided into a user number field and a serial number field in order to verify the uniqueness of data assigned by the user. Or the application data field may be entirely used for set data assigned by the user so that the uniqueness of numbers assigned by the user can be verified.

According to the invention, production numbers can be set in ROM type RFID chips on the basis of a user's request. In addition, the cost of communication can be reduced because the verification for checking whether the products are genuine can be dispensed with.

DESCRIPTION OF THE EMBODIMENTS

Figure 1:
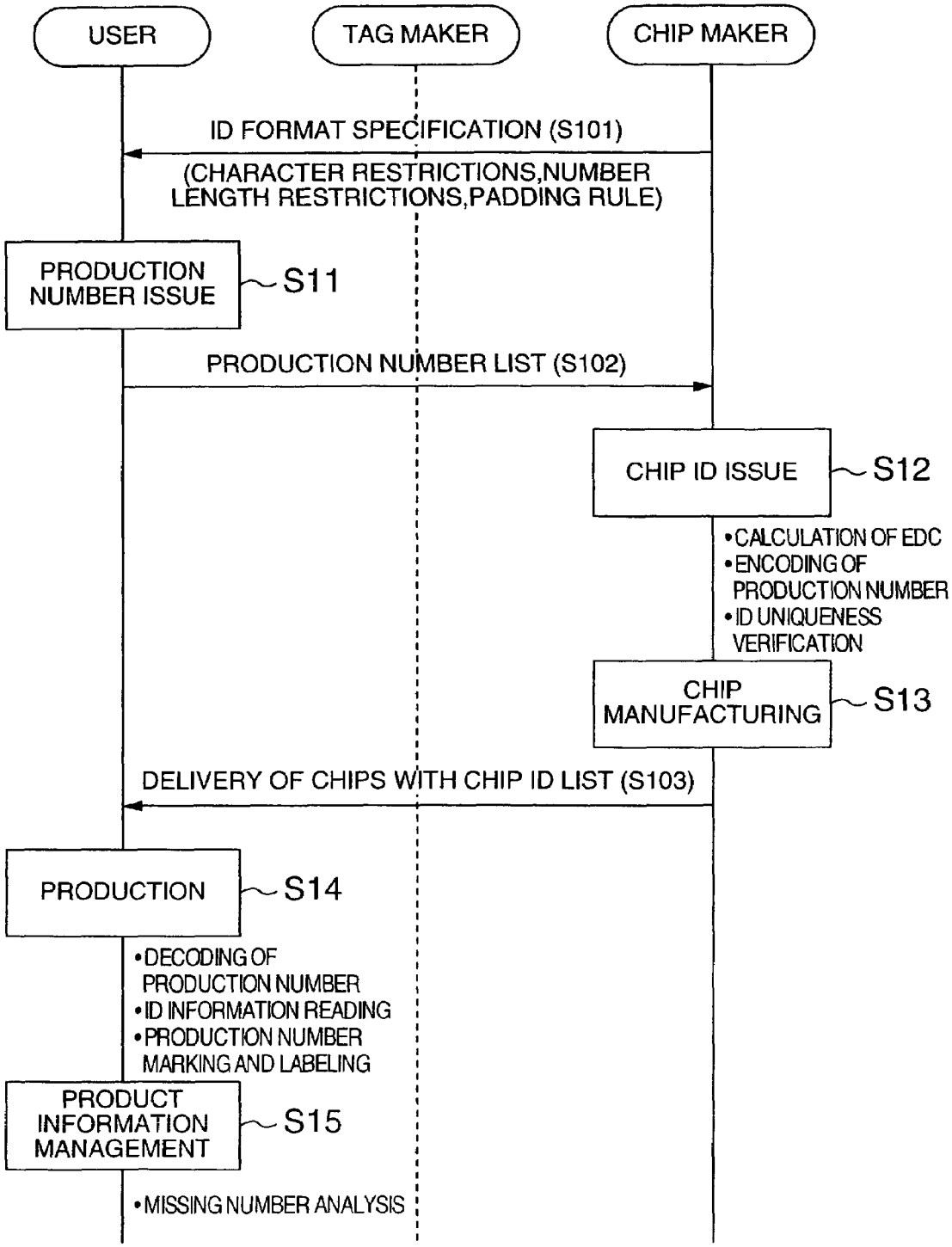
FIG. 1 is a sequence view for explaining a product number setting method applied to ROM type RFID chips in an embodiment of the invention.

FIG. 1 is a sequence view for explaining a product number setting method applied to ROM type RFID chips in an embodiment of the invention.

The relation between a user and a chip maker is shown in FIG. 1. As occasion demands, a tag maker may mediate between the user and the chip maker. For production of chips, the chip maker transmits ID format specifications (restrictions) such as character restrictions, number length restrictions, padding rule, etc. to the user (S101). The user issues the production numbers of user's products (such as drink, cloth or drugs) while considering these restrictions (S11). The issued contents are delivered or transmitted as a production number list to the chip maker through a recording medium such as a CD-R or a magnetic tape or through a communication protocol such as FTP (File Transfer Protocol) (S102). Incidentally, the term "production number" used in this embodiment is equivalent to "product number".

Upon reception of the production number list, the chip maker assigns chip IDs (S12). On this occasion, an ID format is generated so that an EDC is calculated while a header is added to each chip ID. The ID format specification will be described later.

Each production number may be encoded. The reason why the production number is encoded is that the length of a storage field of each ROM type RFID chip is limited. ID uniqueness of each number assigned by the user is further verified. That is, ID uniqueness is verified to check whether the user assigns duplicate IDs or not. Such duplicate IDs are excluded if necessary. Then, in a semiconductor production apparatus, while a lithographic technique is applied onto a silicon wafer to produce IC chips having unique IDs, the IC wafer is cut into IC chips and antennas are attached to the IC chips respectively to produce ROM type RFID chips (S13).

Incidentally, as will be described later, the uniqueness verification is achieved in such a manner that an application data field in each ID format is divided into a user number field and a serial number field or in such a manner that the application data field is entirely used as the field of each number assigned by the user so that the uniqueness of the number assigned by the user can be verified. According to the former manner, efficiency of utilization of the ID field is reduced but labor for verification in the latter manner can be dispensed with.

The ROM type RFID chips produced as described above, as well as the chip ID list, are delivered to the user (delivery, S103). Incidentally, for example, the chip ID list can be delivered through a recording medium such as a CD-R or a magnetic tape or through a communication protocol such as FTP in the same manner as described above.

Upon reception of the ROM type RFID chips, the user produces products as described above (S14) so that the ROM type RFID chips are mounted in the products respectively. On this occasion, ID information is read. Moreover, a production number is extracted and the product is marked, labeled or printed with the production number by production number indicating means such as a marker, a labeler or a printer (so that the production number can be indicated). Incidentally, in the chip maker, production numbers are encoded when chip IDs are assigned. It is therefore necessary to decode the encoded production numbers on the basis of the same table as the character conversion table used at the time of the encoding.

After the production, the user manages product information (S15). In S15, missing number analysis is executed. The missing number management executed here relates to the yield of chip manufacturing.

Specifically, when an ROM type RFID chip is mounted in a product, ID (ID information) is read and the product is marked or labeled. Then, the read ID and the extracted production number are registered in a database while associated with each other so that product information can be managed.

As a result, missing numbers related to the yield of the ROM type RFID chips etc. can be analyzed on the basis of the production number list (which is a list of production numbers assigned by the user or in accordance with the user specifications) and the product information (which is generated after the ROM type RFID chips are mounted in the products respectively). Incidentally, such missing numbers are caused by a loss at the time of cutting the silicon wafer into IC chips having IDs written therein, a loss at the time of handling the IC chips, and so on, for example, in a semiconductor production apparatus. For example, such missing numbers can be compensated for as follows. When the user executes the missing number analysis, a list of missing numbers is generated. The missing number list is transmitted to the chip maker to reorder ROM type RFID chips corresponding to the missing numbers. The chip maker produces the ROM type RFID chips corresponding to the missing numbers again by the semiconductor production apparatus in accordance with the missing number list and delivers the ROM type RFID chips to the user.

Since the uniqueness of each production number assigned by the user can be verified, reliable product management can be achieved while a finite storage space can be prevented from being used wastefully. Incidentally, when duplicate numbers are found, measures may be taken so that one of the duplicate numbers is deleted or sub-numbers are given to the duplicate numbers.

On the other hand, in the case of the RAM type RFID chips in which the user can write information, production numbers can be set by the steps of: (1) sending ID format specifications from a chip maker to a user; (2) designing a user ID format (in consideration of character restrictions, number length restrictions, padding rule, etc.); (3) issuing production numbers from a user production number issue apparatus (such as a personal computer); and (4) tying the RAM type RFID chips bought from the chip maker with products produced by the user in a user production apparatus (i.e. encoding a production number, writing the encoded production number in the RAM type RFID chip and marking or printing the RAM type RFID chip with the production number).

Figure 2:
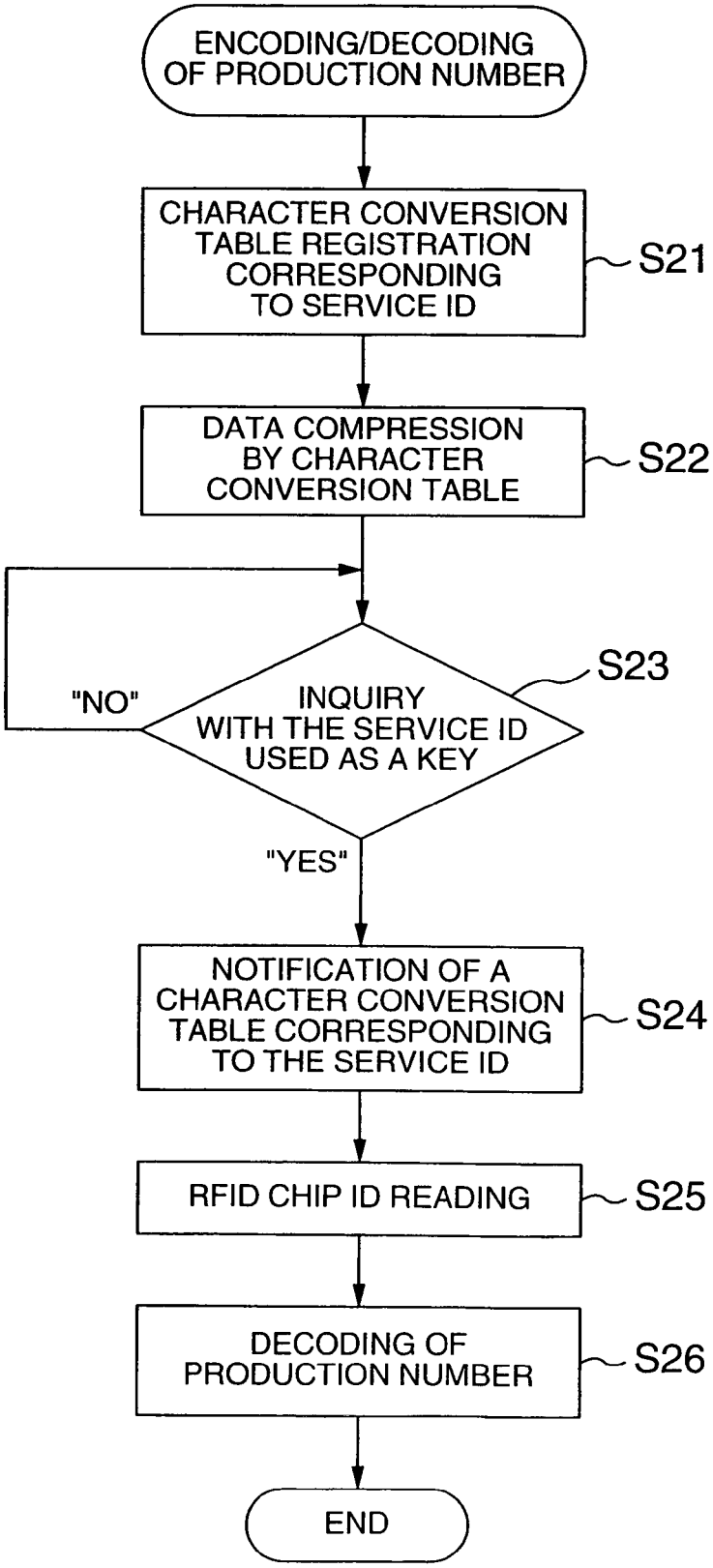
FIG. 2 is a flow chart showing a procedure for encoding/decoding each production number in the embodiment of the invention.

FIG. 2 is a flow chart showing a detailed procedure for encoding/decoding the production number. According to this flow chart, a product number setting apparatus 3 shown in FIG. 6 and provided on the chip maker side registers a character conversion table corresponding to a service ID (user identification information) in a production number management server 1 (S21) and compresses the production number in accordance with the registered character conversion table (data compression, S22).

Figure 6:
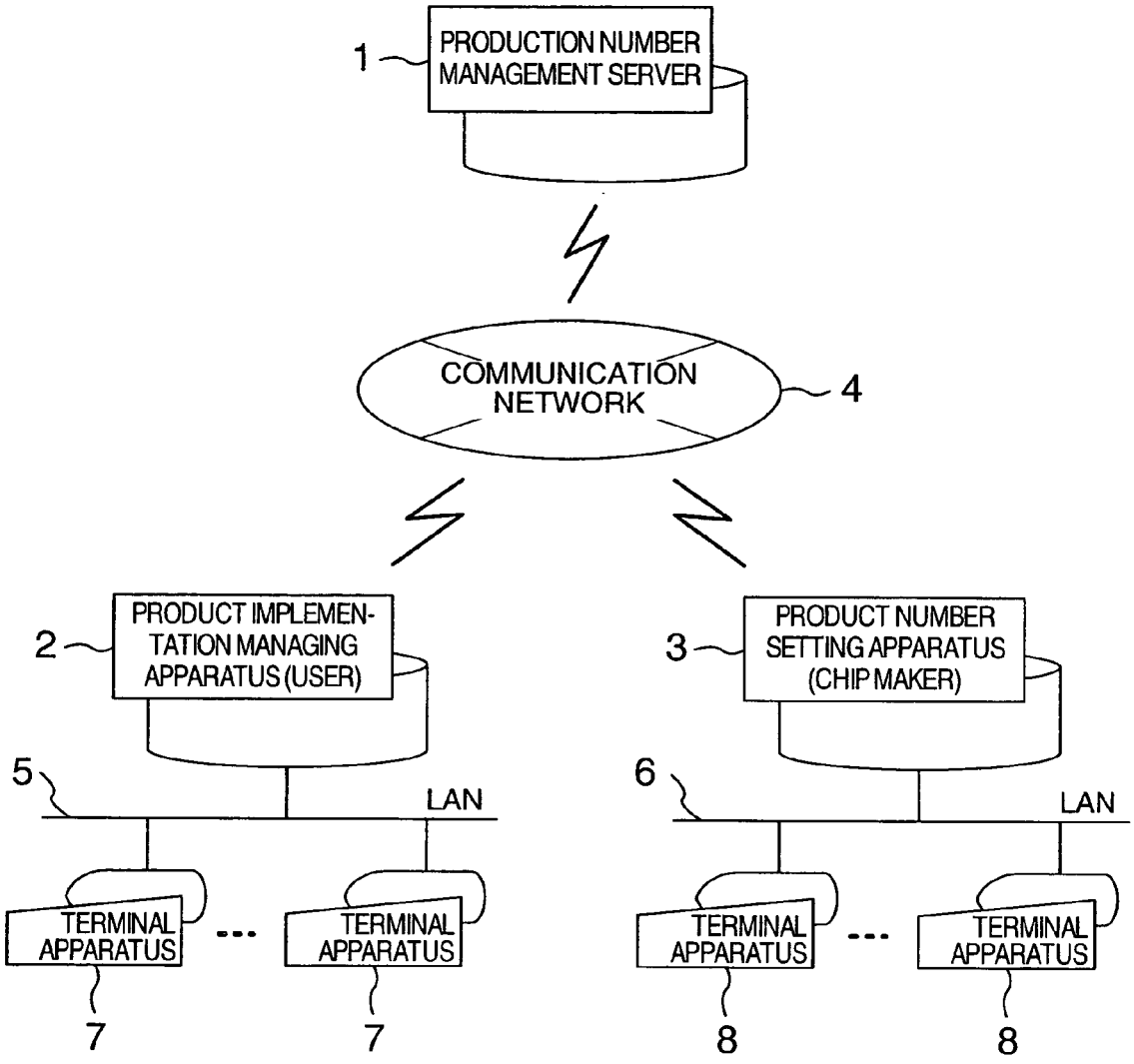
FIG. 6 is a diagram showing an example of a client server system used in the embodiment of the invention.

Then, a product implementation managing apparatus 2 shown in FIG. 6 and provided on the user side inquires of the production number management server 1 (S23) with the service ID used as a key when the production number is decoded. When there is data conformed to the service ID ("YES" in S23), the production number management server 1 notifies the product implementation managing apparatus 2 of the same character conversion table as used at the time of encoding performed by the product number setting apparatus 3 (notification of a character conversion table corresponding to the service ID, S24) and permits the user to read the ID of the ROM type RFID chip (S25). As a result, the product implementation managing apparatus 2 provided on the user side can read the production number normally (decoding of the production number, S26). Inquiry and notification about the character conversion table are executed on the basis of communication due to a server client system which will be described later. Incidentally, when the step S23 results in "NO", the step S23 may be repeated or this routine may be terminated (End).

Figures 3, 4:
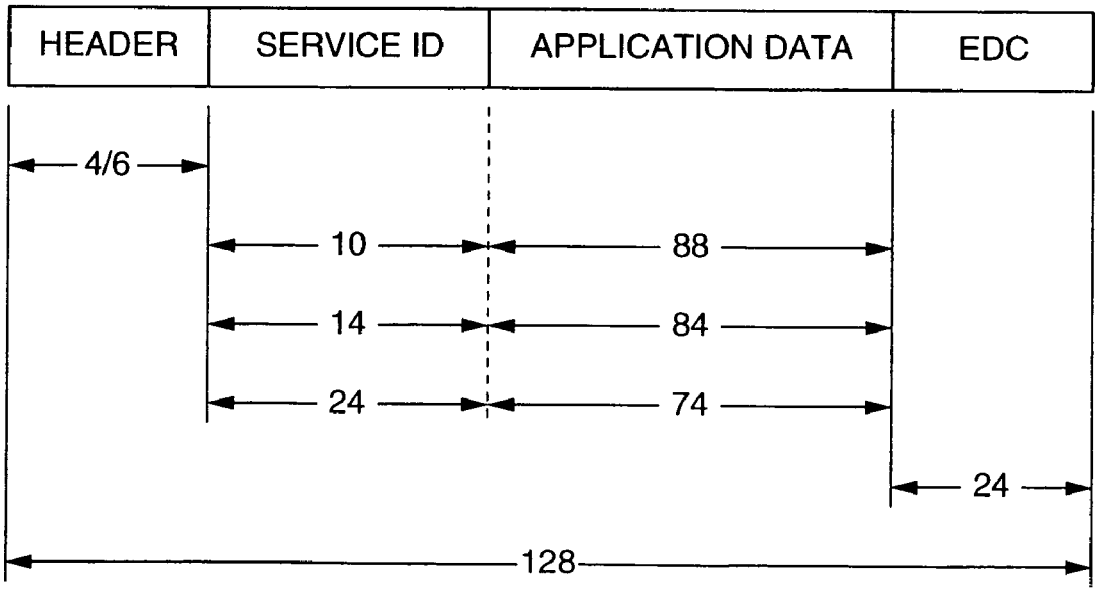
FIG. 3 is a view showing an example of a character conversion table used in the embodiment of the invention.
FIG. 4 is a view showing an example of an ID format used in the embodiment of the invention.

FIG. 3 shows an example of data structure of the character conversion table. Because the storage field of each ROM type RFID chip is finite, there is such consideration that a number space for setting production numbers can be made as large as possible. FIG. 3 shows the case where each ANK (Alphabetic Numeric and Kana) character is compressed into and expressed by 6 bits. Although FIG. 3 shows the case where alphabets (A) ranging from A to Z, numerals (N) ranging from 0 to 9 and six symbols are used, kana characters (K) may be used in place of or in addition to these characters.

FIG. 4 is a view showing the configuration of an ID format for each ROM type RFID chip used in this embodiment. Incidentally, each numeral shown in FIG. 4 expresses the number of bits.

As shown in FIG. 4, the ID format is composed of 128 bits as a whole. In the ID format, a header has a length of 4 or 6 bits. Accordingly, the header is formed so that 16 or 64 kinds of service IDs can be discriminated from one another. A service ID is assigned in common to specific applications or categories. Besides the service ID, intrinsic data identified in a specific application or category and service data for holding sequential numbers to identify ROM type RFID chips having the same service ID are set in an application data field.

In this embodiment, service data peculiar to each user can be set in the application data field as follows. When the service ID (user identification information) has a length of 10 bits, the application data field has a length of 88 bits. When the service ID has a length of 14 bits, the application data field has a length of 84 bits. When the service ID has a length of 24 bits, the application data field has a length of 74 bits. These numbers of bits decide the number of service IDs allowed to be provided and the length of service data. Incidentally, in FIG. 4, the ID format is composed of 128 bits as a whole when the header has a length of 6 bits.

Incidentally, when the application data (application data field) is further divided into a user number setting field and a production number setting field, uniqueness of each production number can be guaranteed.

Though not shown in FIG. 4, a service ID having a length of 36 bits may be provided so that a code corresponding to an EAN (European Article Number) code (international article code) can be used as a service identification code. When, for example, about 10000 IDs (13 or 14 bits) are assigned as issue number IDs for indicating the issue request number (see the step S11 in FIG. 1), uniqueness of IDs different in issue number can be secured. Incidentally, because uniqueness of each ID is verified in accordance with the issue number (see the step S12 in FIG. 1), uniqueness of ID corresponding to the same issue number can be secured.

The EDC having a length of residual 24 bits is provided for checking data read error. The EDC makes the same operation as that of parity used in parity check for confirming ID matching. After the EDC is checked, only normal data is used. Data that cannot satisfy the EDC check is treated as invalid data. Whether a product is genuine can be checked as follows. The tag information of the ROM type RFID chip stuck to the product is read. If the service identification code ID assigned to the product is included in the tag information, the product can be regarded as being genuine. In this manner, the ROM type RFID chip can be used so that the product is regarded as being genuine if legal service ID is contained in the tag information read from the product provided with the ROM type RFID chip.

Figure 5:
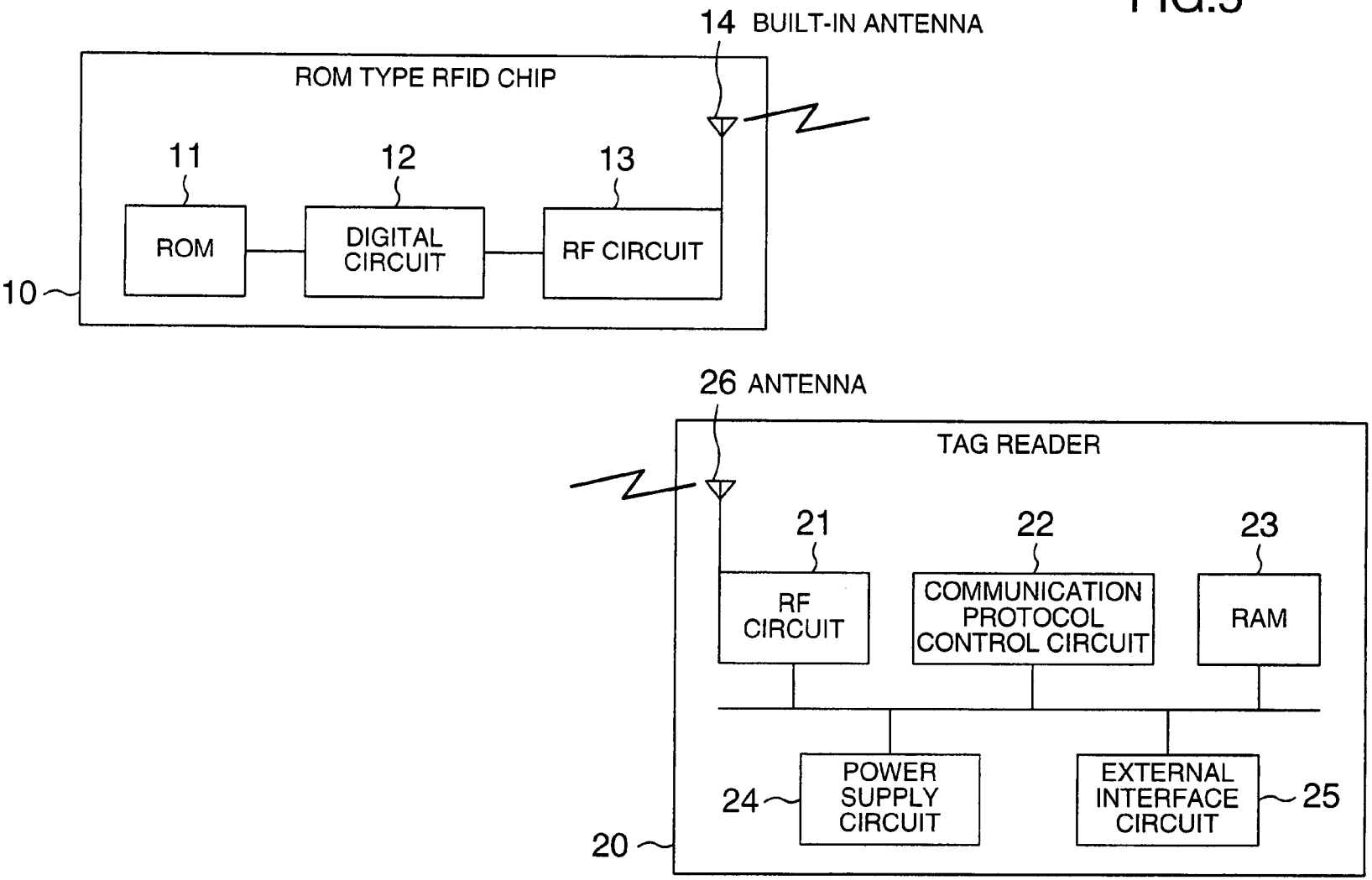
FIG. 5 is a block diagram showing the internal configuration of an ROM type RFID chip and a tag reader used in the embodiment of the invention.

FIG. 5 is a block diagram showing the internal configuration of an ROM type RFID chip used in this embodiment of the invention and a tag reader for reading the contents of the ROM type RFID chip.

The ROM type RFID chip 10 is an IC chip which is managed on the basis of unique ID information and which includes an ROM 11, a radio frequency (RF) circuit 13, and a digital circuit 12 for connecting the ROM 11 and the RF circuit 13 to each other. The ROM type RFID chip 10 is driven by electric wave given from the tag reader 20. Electric wave emitted from the tag reader 20 is received by an antenna 14 which is attached to the outside of the chip or included in the chip. The RF circuit 13 generates electric power by electromagnetic induction using the received electric wave and transmits data recorded in the ROM 11. The data includes the sequential production number for specifying the chip per se.

The tag reader 20 includes a radio frequency (RF) circuit 21, a communication protocol control circuit 22, an RAM 23, a power supply circuit 24, and an external interface circuit 25.

The tag reader 20 performs convergence control through the communication protocol control circuit 22 under the control of a not-shown CPU. Electric wave emitted from the ROM type RFID chip 10 at a distance permitting the electric wave to reach the tag reader 20 is received by the radio frequency (RF) circuit 21 through an antenna 26, so that data of the ROM type RFID chip 10 is taken in the tag reader 20. Incidentally, the data taken in the tag reader 20 is uploaded to a product implementation managing apparatus 2, for example, through a terminal apparatus 7 connected to the tag reader 20 through the external interface circuit 25. In the product implementation managing apparatus 2, an application program prepared in advance is executed to accomplish its purpose.

FIG. 6 shows an example of an ROM type RFID chip producing and product implementation managing system for achieving the production number setting method and the product implementation managing method applied to ROM type RFID chips according to the invention. In this embodiment, this system is provided as a server client system.

In FIG. 6, the reference numeral 1 designates a production number management server. A product implementation managing apparatus 2 is provided so that a user can manage products. A product number setting apparatus 3 is provided so that a semiconductor maker can manage production of ROM type RFID chips. The production number management server 1 is connected to the product implementation managing apparatus 2 and the product number setting apparatus 3 through a communication network 4. The communication network 4 may be a private line network or may be an open line network such as the Internet. The product implementation managing apparatus 2 and the product number setting apparatus 3 are connected to LANs 5 and 6 respectively. Terminal apparatuses 7 and 8 are connected to the product implementation managing apparatus 2 and the product number setting apparatus 3 through the LANs 5 and 6 respectively. The product implementation managing apparatus 2 and the product number setting apparatus 3 perform management of products and management of production of ROM type RFID chips by communicating with the terminal apparatuses 7 and 8 through the LANs 5 and 6 respectively.

Figure 7:
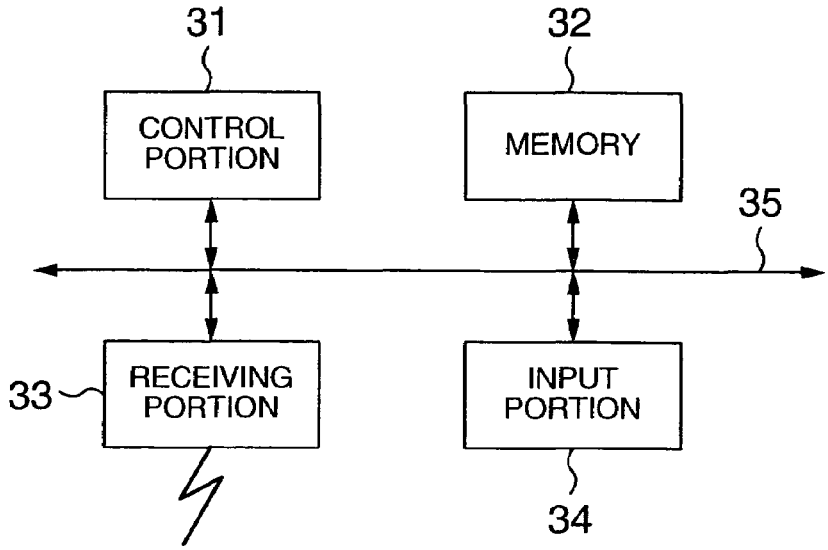
FIG. 7 is a diagram showing an example of the internal configuration of a product number setting apparatus in the client server system depicted in FIG. 6.
Figure 8:
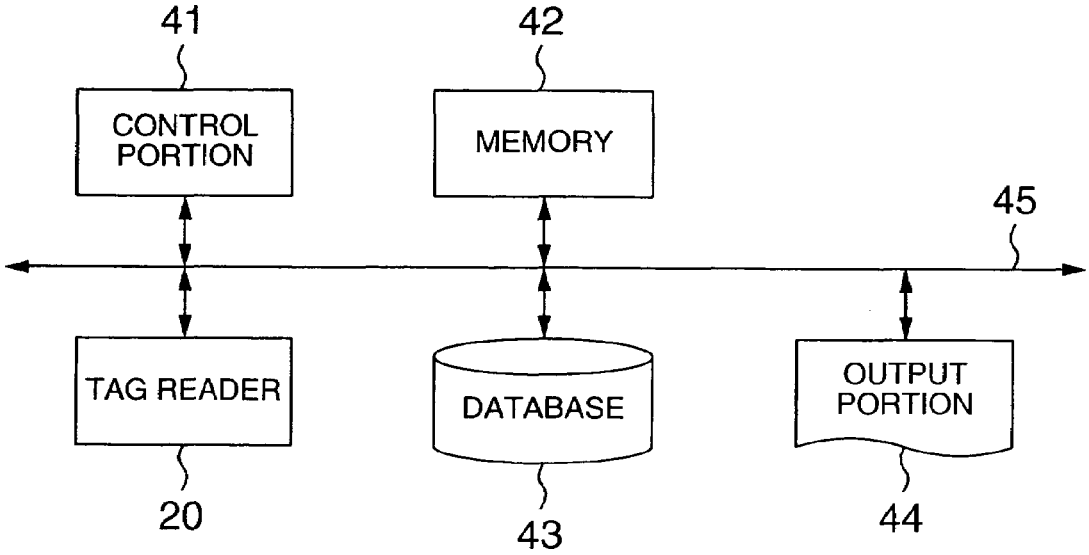
FIG. 8 is a diagram showing an example of the internal configuration of a product implementation managing apparatus in the client server system depicted in FIG. 6.

FIG. 7 shows an example of the internal configuration of the product number setting apparatus 3. FIG. 8 shows an example of the internal configuration of the product implementation managing apparatus 2.

As shown in FIG. 7, the product number setting apparatus 3 includes a control portion 31, a memory 32, a receiving portion 33, and an input portion 34. The constituent members 31 to 34 of the product number setting apparatus 3 are connected to one another through a bus 35 composed of address, data and control lines.

The product number setting apparatus 3 configured as described above operates as follows. Production numbers assigned by the user are received in the product number setting apparatus 3 by the receiving portion 33 through the communication network 4. Or production numbers assigned in accordance with the user specification are taken in the product number setting apparatus 3 through the input portion 34. The control portion 31 sequentially sets the assigned product numbers in the application data fields of ROM type RFID chips 10 respectively on the basis of the ID format specification defined in advance in accordance with a program recorded in the memory 32 and gives instructions to produce ROM type RFID chips.

As shown in FIG. 8, the product implementation managing apparatus 2 includes a control portion 41, a memory 42, a tag reader 20, a database 43 (external memory), and an output portion 44. The constituent members 20 and 41 to 44 are connected to one another through a bus 45 composed of address, data and control lines.

The product implementation managing apparatus 2 configured as described above operates as follows. After an ROM type RFID chip 10 is mounted in each user product, chip information of the ROM type RFID chip 10 is read by the tag reader 20 under the program control of the control portion 41. The production number extracted from the read information is registered in the database 43 so as to be associated with the user product. The user product is marked, printed or labeled with the extracted production number through the input portion 44 (i.e. the production number is displayed).

At the time of encoding of the production number, the product number setting apparatus 3 registers the character conversion table in the production number management server 1. At the time of decoding, the product implementation managing apparatus 2 inquires of the production number management server 1 and receives download service from the production number management server 1.

When the aforementioned server client system is used, the load imposed on an operating person as required for delivering the production number list and the chip ID list can be reduced. Incidentally, the production number management server 1 may be provided and managed either on the semiconductor maker side or on the user side or may be provided and managed on the tag maker side which mediates between the semiconductor maker side and the user side.

As described above, in accordance with the invention, the chip maker is instructed to produce ROM type RFID chips in the condition that production numbers assigned by the user are set sequentially in the application data fields of ROM type RFID chips respectively on the basis of the ID format specification defined in advance. For this reason, data can be recorded in accordance with the user's request. Because data can be recorded in accordance with the user's request, verification for checking whether the product is genuine can be dispensed with. Accordingly, communication executed for verification at each time it happens can be dispensed with, so that the cost of communication can be reduced.

Incidentally, there is the movement of standardization called EPC (Electric Protocol Code) to standardize a production code into data to be stored in an RFID chip. The problem as to whether this standardization can be achieved on ROM type RFID chips has been not solved yet. According to this embodiment of the invention, ROM type RFID chips according to EPC can be provided because the product code corresponds to the production number.

When data including an error check code generated for checking data matching, and a header of n bits for discriminating $2^n$ kinds of service IDs is set so as to be added to the production number set in the application data field, ID matching can be verified.

That is, whether a product is genuine can be checked as follows. The tag information of the ROM type RFID chip stuck onto the product is read. If the service identification code assigned to the product is included in the tag information, the product can be regarded as being genuine. The ROM type RFID chip can be used so that the product is regarded as being genuine if the legal service identification code is included in the tag information when the tag information of the product provided with the ROM type RFID chip is read in this manner.

The application data field may be further divided into a user number setting field and a production number setting field to guarantee uniqueness of the production number. Or the production number assigned by the user may be assigned to the application data field as a whole. In the case where duplicate production numbers are found when uniqueness is verified, one of the duplicate numbers may be deleted or sub-numbers may be added so that management can be made on the basis of the sub-numbers. In this manner, reliable product management can be made.

Compressed alphabetic characters may be assigned to the production numbers so that compression or restoration can be made by use of the same conversion table at the time of number issue or at the time of number reading. Or missing numbers caused by the yield of ROM type RFID chips may be analyzed on the basis of the production number list (which is a list of production numbers assigned) and the product information (which is generated after the ROM type RFID chips are mounted in the products respectively) so that the missing numbers can be assigned to other products. In this manner, number space restrictions caused by capacity restrictions can be utilized effectively.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A method of setting the numbers of products in RFID chips respectively by using a computer, comprising the steps of:

sending from a user apparatus to a chip maker apparatus a product number list including production numbers assigned in accordance with a user's instruction;

encoding, in said chip maker apparatus, said production numbers into chip IDs by using a character conversion table to thereby manufacture RFID chips having said chip IDs;

sending said character conversion table from said chip maker apparatus to a production number management server through a communication network;

storing said character conversion table in said production number management server;

obtaining, in said user apparatus, said character conversion table by using a user ID of said user apparatus;

obtaining an ID code by use of said user ID from said production number management server; and decoding said ID code into a production number based on said character conversion table.

2. A method according to claim 1, further comprising a step of decoding said chip IDs received from said RFID chips in a user apparatus that has received said RFID chips, and obtaining numbers to be printed on labels to be attached to said products in which said RFID chips are mounted respectively.

3. A method according to claim 1, wherein said character conversion table corresponds to ID information for each user according to which said user apparatus obtains said character conversion table.

4. A method according to claim 3, wherein:

said application data field has a user number field unique for said user, and a serial number field for the encoded chip IDs; and the verifying step is carried out in said user number field.

5. A product number setting method according to claim 3, further comprising a step of adding data composed of an error check code generated for verifying product number matching and a header of n bits for discriminating $2^n$ kinds of service IDs to the product number set in each of said application data fields to thereby form the ID format.

6. A method according to claim 3, wherein said user apparatus verifies whether or not each encoded chip is not duplicate to any ID having been already assigned by the user after encoding of said production numbers.

7. A product number setting method according to claim 6, further comprising a step of managing duplication of said product numbers so that when duplicate product numbers are found as a result of uniqueness verification, management is made so that one of said duplicate product numbers is deleted or sub-numbers are added to said duplicate product numbers respectively.

8. A product number setting method according to claim 3, further comprising a step of assigning at least one of numeric and alphabetic characters as each product number, compressing said assigned product numbers by using a conversion table and setting the compressed product numbers in said ROM type RFID chips respectively.

9. A system of setting the numbers of products in RFID chips, comprising:

a user apparatus;

a chip maker apparatus connected to said user apparatus; and a production number management server connected to said user apparatus and said chip maker apparatus;

wherein said user apparatus sends a product number list including production numbers assigned in accordance with a user's instruction to said chip maker apparatus;

wherein said chip maker apparatus encodes said production numbers into chip IDs by using a character conversion table thereby to manufacture RFID chips having chip IDs, respectively and sends said character conversion table to said production number management server through a communication network;

wherein said production number management server stores said character conversion table;

wherein said user apparatus obtains said character conversion table by using a user ID of said user apparatus, obtains an ID code by use of said user ID from said production number management server, and decodes said ID code into a production number based on said character conversion table.

10. A system according to claim 9, wherein said user apparatus decodes said chip IDs received from said RFID chips through antennas provided therein, and obtains numbers to be printed on labels to be attached to said products in which said RFID chips are mounted respectively.

* * * * *